United States Patent [19]

Seabolt

[11] Patent Number: 4,893,723

[45] Date of Patent: Jan. 16, 1990

[54] PAINT CAN ATTACHMENT

[76] Inventor: John K. Seabolt, 405 Jones Chapel Rd., Richlands, Va. 24621

[21] Appl. No.: 212,585

[22] Filed: Jun. 28, 1988

[51] Int. Cl.[4] ..... B65D 25/00

[52] U.S. Cl. ..... 220/85 SP; 220/90; 220/90.4; 222/570; 222/485

[58] Field of Search ..... 220/85 SP, 90, 90.2, 220/90.4; 206/15.2, 15.3, 362.1, 362.2, 362.3, 223; 222/478, 485, 566, 567, 570

[56] References Cited

U.S. PATENT DOCUMENTS

| | | | |
|---|---|---|---|
| 761,342 | 5/1904 | Westerbeck | 222/478 |
| 2,550,568 | 4/1951 | Kersh | 222/567 |
| 2,873,052 | 2/1959 | Atherton | 222/570 |
| 3,262,612 | 7/1966 | Tabor | 222/570 |
| 3,307,752 | 3/1967 | Anderson | 222/570 |
| 3,329,307 | 7/1967 | Jacobson | 220/90 |
| 3,372,832 | 3/1968 | Yeater et al. | 222/570 |
| 3,980,213 | 9/1976 | Ramsay | 222/570 |
| 4,034,901 | 7/1977 | Kirk | 222/570 |
| 4,203,537 | 5/1980 | McAlister | 220/90 |
| 4,225,064 | 9/1980 | Westcott | 222/570 |

OTHER PUBLICATIONS

"Materials and Methods", by Dupont Apr. 1951, p. opposite p. 230.

*Primary Examiner*—David T. Fidei
*Attorney, Agent, or Firm*—Richard C. Litman

[57] ABSTRACT

An attachment for a cylindrical container is disclosed. The attachment is secured and sealed on the open top of the can by a seal which mates with the rim of the container. The attachment includes a pour spout with a cap, an access opening with a cover, and a paint paddle scraper along with a comb for cleaning the paint from brushes.

7 Claims, 2 Drawing Sheets

Fig. 1
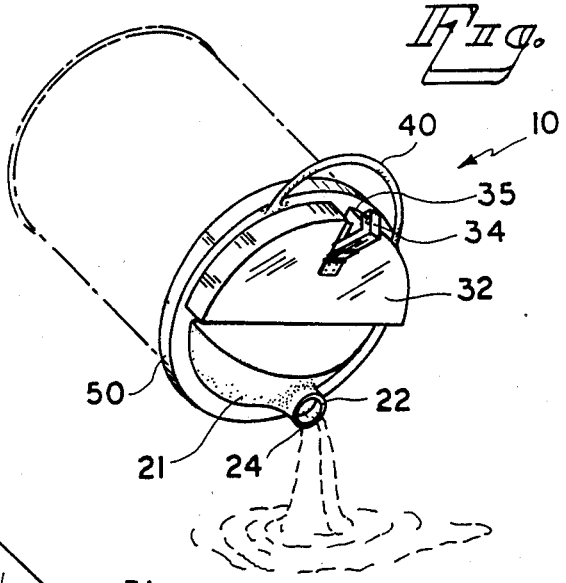
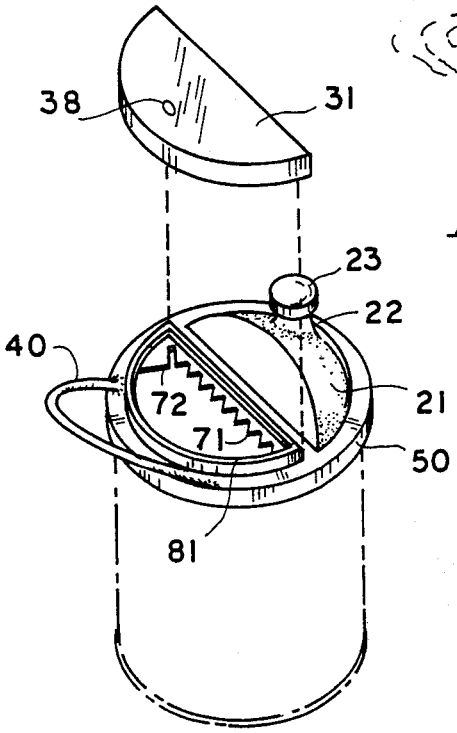
Fig. 3
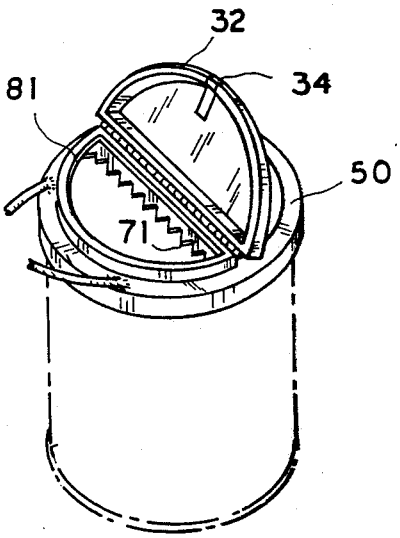
Fig. 2

PAINT CAN ATTACHMENT

BACKGROUND OF INVENTION

Painters, and others who must apply material with a brush from a large container, are often caused inconvenience by conventional can lids. In particular, paint can lids are awkward to store once removed. Further, paint often remains in the rim of the can after pouring, causing the lid to become stuck when replaced, or causing paint to drip over the rim. As a result, there is a need for a paint can attachment which facilitates pouring of paint and resealing of the paint can.

FIELD OF INVENTION

The invention relates to an improved apparatus for use with a paint can, and more particularly, the invention is directed to an improved paint can cover and pouring funnel.

The invention further relates to an improved paint can apparatus which provides means for cleaning excess paint from brushes, paint stir paddles, and other utensils. More particularly, the invention is directed to providing a plurality of attachments to a paint can lid, including a pouring funnel, a rim sealing means, a squeegee for scraping of paint stirring paddles, and a comb for the smoothing of brushes. The device is also used to clean excess paint from paint stirrers.

The invention can be used for a variety of types of paint cans that have removable lids, and the method of construction of the device is more fully described herein.

DESCRIPTION OF THE PRIOR ART

Various prior art paint can funnel devices, lids, and the like, as well a their apparatuses and the method of their construction in general, are known and found to be exemplary of the U.S. prior art.

U.S. Pat. No. 2,520,549, issued to Jacobsen, discloses a detachable pouring spout for cans of the flat top variety. The spout includes an arcuate cut out portion at its rear end. U.S. Pat. No. 2,840,124, to Greene, discloses a reusable dispensing cover for cans. U.S. Pat. No. 2,842,167 to Tupper, teaches a container closure which has a pouring spout thereon.

Other devices are known which provide a flat lid with a rectangular pour opening for paint cans. However, these devices do not provide any type of funnel for the pour spout.

These patents or known prior uses teach and disclose various types of paint can funnels and lids of sorts and various manufactures, and the like, as well as methods of their construction; but none of them, whether taken singly or in combination, disclose the specific details of the combination of the invention in such a way as to bear upon the claims of the present invention.

SUMMARY OF INVENTION

An object, advantage, and feature of the invention is to provide a novel paint can attachment that is efficient and practical in use, and lends itself to attachment to paint cans.

Another object of the invention is directed further to a device providing for the easy pouring of paint or other liquids from flat top cans.

Another object of the invention is directed to a device which seals the rim of paint cans, preventing paint from clogging the rim. This is a substantial improvement over existing practices, where paint will clog the rim, causing the lid to stick when replaced.

Yet another object of the invention is to provide a novel and improved construction of a cleaner for paint stirring paddles, to wit, the employment of a squeegee element disposed on the paint can attachment itself.

Still another object of the invention is to provide a novel and improved method of construction of a paint can attachment, whereby a brush cleaning means is incorporated therein, allowing for the cleaning and combing of brushes without causing paint to clog the rim of the can.

Another object of the invention is to provide a novel and improved construction of a paint can attachment, which includes a funnel that also seves to create an air void between the paint in the can and the underside of the attachment. This air void is of sufficient volume to facilitate agitation of paint by shaking the can.

These, together with other objects and advantages of the invention reside in the details of the process and the operation thereof, as is more fully hereinafter described and claimed. References are made to drawings forming a part hereof, wherein like numerals refer to like parts throughout.

DESCRIPTION OF THE SEVERAL VIEWS OF THE DRAWINGS

FIG. 1 is a perspective view of a paint can attachment according to a first embodiment of the invention, showing the invention in use as a pour spout.

FIG. 2 is a perspective view of a paint can attachment according to a first embodiment of the invention.

FIG. 3 is a perspective view of the invention according to a second embodiment.

DESCRIPTION OF THE PREFERRED EMBODIMENTS OF THE INVENTION

Figure 4:
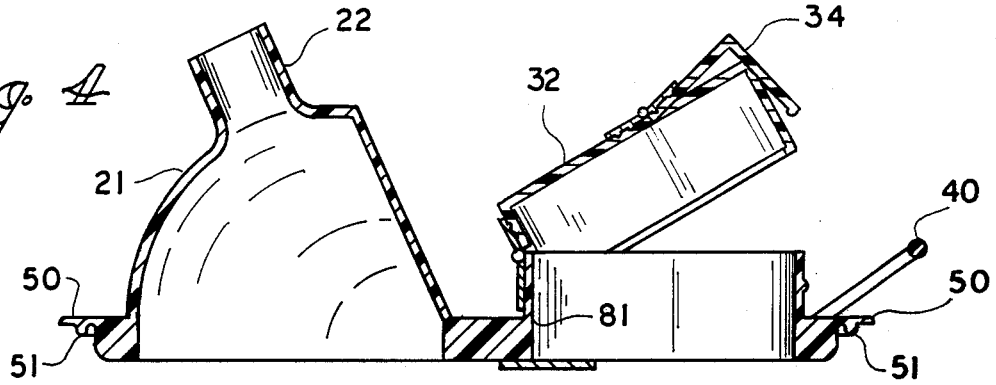
FIG. 4 is a side section view of the invention according the the first embodiment, showing one type of rim attaching and sealing means.

Referring now to the drawings, there is shown in FIGS. 1 and 2 perspective views of one preferred embodiment of the invention in operation. The paint can apparatus, generally designated 10, is seen to comprise a funnel 21 leading into a pour spout 22, having a removable spout cap 23. The pour spout 22 may include a small flange 24, which helps to eliminate paint drips over the edge of the spout while pouring. The apparatus is secured to the paint can by an attaching and sealing ring 50. The first embodiment includes an opening 81 with a hinged cover 32. When closed, the hinged cover 32 seals the can. The hinged cover 32 also includes a slot 35, which serves as both an air inlet for air while pouring, and as a squeegee, or scraper, for removing excess paint from paint can stirrers. A preferred method for using the slot 35 as a scraper includes closing the hinged lid 32 while inserting the paint paddle, and then removing the paint paddle, pulling the paddle upwards against the slot 35 to clean away excess paint. The slot 35 is provided with a hinged slot cover 34, which when closed seals the can.

This embodiment of the invention also includes a paint brush comb 71 disposed along the edge of opening 81. The paint brush comb 71 is accessible when the hinged cover 32 is open. The paint brush comb 71 may be used to remove excess paint from paint brushes, and to comb or straighten the bristles of the brush. A handle 40 is connected to attaching and sealing ring 50 to facilitate removal of the lid.

FIG. 3 shows a second embodiment of the invention, wherein a removable cover 37 is provided to cover opening 81. In this embodiment, the removable cover 37 may be provided within air inlet 38, to allow pouring with the removable cover 37 closed. The paint paddle slot 72 and paint brush comb 71 are disposed along the edge of opening 81. Thus, the paint paddle slot 72 and the paint brush comb 71 are accessible when the removable cover 37 is removed. A preferred method for using the slot as a scraper includes inserting the paint paddle into the slot, and then pulling the paddle upwards to clean away excess paint.

Figure 5:
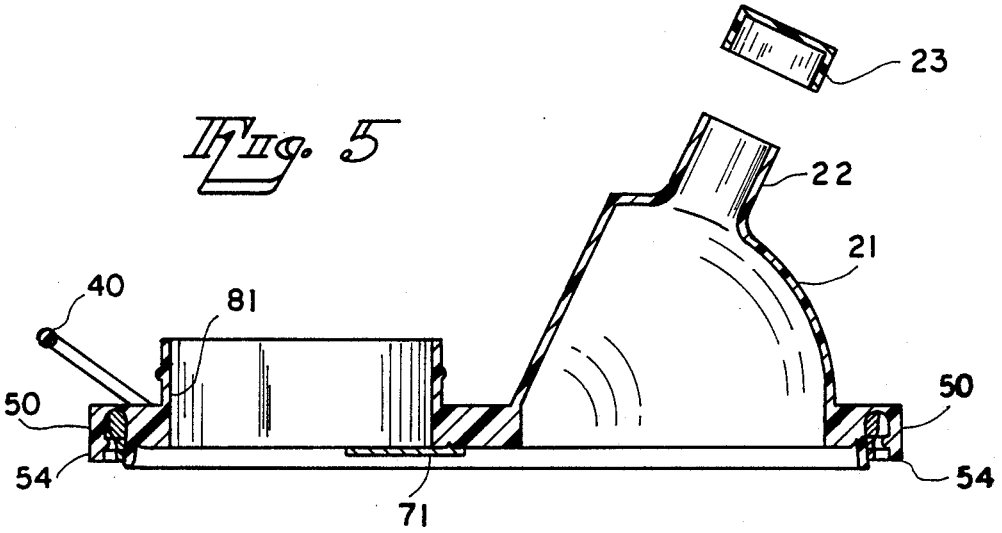
FIGS. 5 and 6 are side section views of the second embodiment of the invention, showing two alternative types of rim attaching and sealing means.
Figure 6:
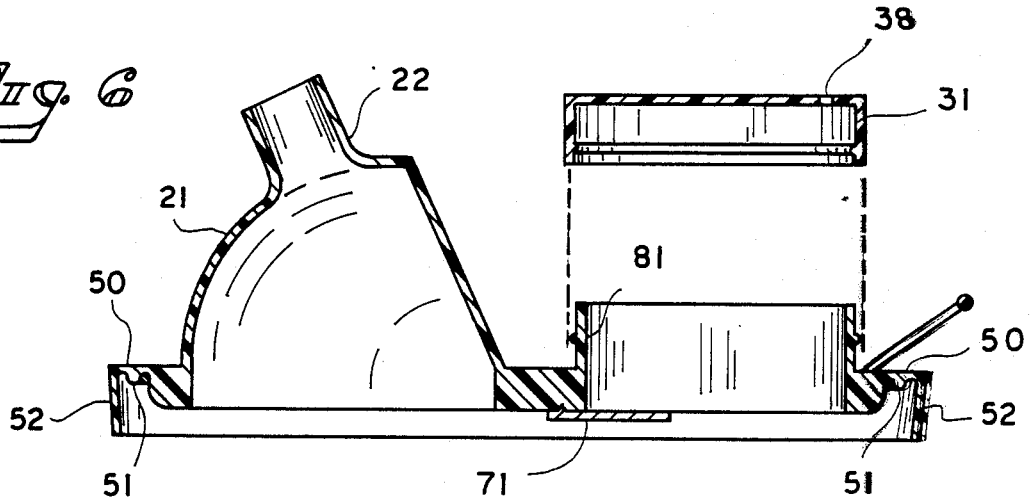

FIGS. 4, 5, and 6 are section views of alternative constructions for the sealing and securing means 50. FIG. 4 shows the first type of sealing and securing means 50, having a rim engaging bead 51. The rim engaging bead 51 fits snugly in the rim of the paint can, much like a conventional can lid. FIG. 6 shows another type of sealing and attaching means 50 including a rim engaging bead 51 in combination with a side flange 52. The side flange 52 provides an additional sealing surface around the rim of the can. FIG. 5 shows another type of sealing and securing means 50, including a side flange 54. This type of sealing and securing means 50 is appropriate for use with the plastic bucket type of paint container.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, fall within the scope of the invention.

I claim:

1. An apparatus for attachment to a rim at the top of a cylindrical container for liquids, comprising:

means for removably attaching and sealing said apparatus to the rim of said cylindrical container;

a pour spout having a pour aperture at the end of said pour spout;

removable cap means adapted to close said pour aperture;

said apparatus including an access aperture therein, said access aperture defining a semicircular configuration;

a cover for said access aperture; and a slot defined by a portion of the edge of said access aperture, said slot providing a squeegee, whereby said squeegee may engage and scrape liquid from both sides of a stir paddle simultaneously, and alternatively retain a stir paddle in a vertical position.

2. An apparatus for attachment to the rim at the top of a cylindrical container for liquids, comprising:

means for removably attaching and sealing said apparatus to the rim of said cylindrical container;

a pour spout having a pour aperture at the end of said pour spout;

removable cap means adapted to close said pour aperture;

said apparatus including an access aperture therein, said access aperture defining a semicircular configuration;

a hingedly mounted cover for said access aperture;

a slot defined by a portion of said hingedly mounted cover, said slot opening to an edge of said cover; and said slot providing a squeegee, whereby said squeegee may engage and scrape liquid from both sides of a stir paddle simultaneously, and alternatively retain a stir paddle in a vertical position.

3. An apparatus for attachment to the rim at the top of a cylindrical container for liquids according to claim 14, wherein:

said cover defines a substantially semicircular configuration having an arc edge and a straight edge;

said cover having a top surface and sides extending downward from said top surface from both said arc edge and said straight edge; and said top surface having a hinge parallel said straight edge, intersecting said arc edge at two distinct points at which said sides are disjoined, whereby when said cover is engaged with said access aperture a part of said cover can be lifted to allow air to enter when pouring liquid from said pour aperture.

4. An apparatus for attachment to the rim at the top of a cylindrical container for liquids according to claim 1 wherein:

said cover is removable and includes an aperture, whereby an air inlet is provided to facilitate pouring liquid from said pour aperture when said cover is engaged with said apparatus.

5. An apparatus according to claim 1, including;

gripping means attached to said apparatus, to facilitate removal of said apparatus from said cylindrical container.

6. An apparatus according to claim 1, including;

serrations along a portion of the edge of said access aperture, so that bristles of a brush may be wiped against said serrations for cleaning of said bristles.

7. An apparatus according to claim 5, wherein;

said gripping means include a handle of generally semi-circular configuration, said handle being rigidly attached to said apparatus; whereby a user can remove said apparatus from said cylindrical container by applying an upward force on said handle.

* * * * *